US010724180B2

(12) United States Patent
Dixon

(10) Patent No.: US 10,724,180 B2
(45) Date of Patent: Jul. 28, 2020

(54) RAIL CLAMP

(71) Applicant: CODIUN LIMITED, Swindon, Wiltshire (GB)

(72) Inventor: Ian Dixon, Swindon (GB)

(73) Assignee: CODIUN LIMITED, Swindon (GB)

( * ) Notice: Subject to any disclaimer, the term of this patent is extended or adjusted under 35 U.S.C. 154(b) by 276 days.

(21) Appl. No.: 15/548,301

(22) PCT Filed: Feb. 2, 2016

(86) PCT No.: PCT/GB2016/050236
§ 371 (c)(1),
(2) Date: Aug. 2, 2017

(87) PCT Pub. No.: WO2016/124910
PCT Pub. Date: Aug. 11, 2016

(65) Prior Publication Data

US 2018/0016753 A1 Jan. 18, 2018

(30) Foreign Application Priority Data

Feb. 3, 2015 (GB) ..... 1501794.0
Feb. 27, 2015 (GB) ..... 1503369.9

(51) Int. Cl.
*E01B 9/60* (2006.01)
*E01B 11/10* (2006.01)
(Continued)

(52) U.S. Cl.
CPC ..... *E01B 9/60* (2013.01); *B01L 1/02* (2013.01); *E01B 11/10* (2013.01); *E01B 11/12* (2013.01); *E01B 35/12* (2013.01)

(58) Field of Classification Search
CPC ..... E01B 9/00; E01B 9/02; E01B 9/28; E01B 9/30; E01B 9/303; E01B 9/306; E01B 9/32; E01B 9/34; E01B 9/60; E01B 9/66
See application file for complete search history.

(56) References Cited

U.S. PATENT DOCUMENTS 969,679 A 9/1910 Williams
998,132 A 7/1911 Souder
(Continued)

FOREIGN PATENT DOCUMENTS

CN 2647695 Y 10/2004
CN 204139010 U 4/2015
(Continued)

OTHER PUBLICATIONS

International Search Report, PCT/GB2016/050236 dated Apr. 19, 2016.
(Continued)

*Primary Examiner* — Robert J McCarry, Jr.
(74) *Attorney, Agent, or Firm* — Perry + Currier Inc.

(57) ABSTRACT

A rail clamp comprising two clamp elements (30*a*, 30*b*) securable together in clamping arrangement about a railway rail, wherein at least one of the clamp elements (30*a*, 30*b*) can include sensor retaining means to hold a sensor to make measurements relating to the rail. A first of said two clamp elements (30*b*) has a clamp head to engage a fish plate (14*b*) or a web-side of a railway rail. A clamp foot (34*b*) engages the underside of a railway rail foot (13). A second of said two clamp elements (30*a*) having a clamp head to engage the opposite fish plate or web-side of a railway rail and a clamp foot (34*a*) to engage the underside of the clamp foot (34*b*) of the first clamp element (34*b*). The first and second clamp elements (30*a*, 30*b*) are secured together by a connector (35), optionally a bolt, to a railway rail.

9 Claims, 6 Drawing Sheets

(51) Int. Cl.

| | |
|---|---|
| ***B01L 1/02*** | (2006.01) |
| *E01B 35/12* | (2006.01) |
| *E01B 11/12* | (2006.01) |

(56) References Cited

U.S. PATENT DOCUMENTS

| | | | | |
|---|---|---|---|---|
| 1,006,719 | A * | 10/1911 | Cameron | E01B 11/10 238/193 |
| 1,037,708 | A | 9/1912 | Zabawa | |
| 1,068,631 | A | 7/1913 | Dalton | |
| 1,117,514 | A | 11/1914 | Owen | |
| 1,835,820 | A | 12/1931 | Stephens | |
| 6,213,407 | B1 * | 4/2001 | Ellis | E01B 21/00 238/310 |
| 2002/0073525 | A1 | 6/2002 | Bruyn | |
| 2009/0178248 | A1 | 7/2009 | Buta et al. | |

FOREIGN PATENT DOCUMENTS

| | | | |
|---|---|---|---|
| DE | 330 951 | C | 12/1920 |
| EP | 0995837 | A1 | 4/2000 |
| JP | H11172606 | A | 6/1999 |

OTHER PUBLICATIONS

Search Report dated Aug. 17, 2016, by UKIPO, re UK Patent Application No. GB1503369.9.

International Preliminary Report on Patentability (IPRP) dated Aug. 8, 2017, by ISA, re PCT Patent Application No. PCT/GB2016/050236.

* cited by examiner

RAIL CLAMP

FIELD OF THE INVENTION

The current invention is concerned with a clamp for use to hold together adjacent rails in a joint, particularly for example where the original joint has broken, become otherwise defective or where a break in the rail has occurred or a rail defect is detected. Additionally, the damp can be used in determining the state of and measuring the stress experienced by a railway rail, and provides a non-invasive device which enables a rail and especially a joint between rails to be monitored remotely.

BACKGROUND TO THE INVENTION

The railways industry is under constant pressure to maintain lower costs and also to increase the safety of rail travel. Any accident can be costly in terms of human life and repair costs and is inevitably scrutinised publicly to determine the cause.

One aspect which is obviously of fundamental importance is the rail on which the trains run. Over the years in which the railways have operated, improvements have been made in the materials and the design of rails to ensure that they are able to withstand large stresses and also the weathering to which they are exposed.

A rail track comprises a series of individual rails, joined together—for example by welding and/or bridging elements to form a continuous length. The rails are usually formed from high quality premium steel for strength and durability. Support for the rails is provided by high quality ballast materials and sleepers laid perpendicularly to the direction of travel.

The joints between rails however remain sources of potential weakness and are frequently the parts of a track most likely to weaken or fail. The usual method of holding two rails together in a joint is to fasten the rails together using what is termed in the art as a fishplate.

Where a defect arises, or as a preventative measure, for example where a section of track is broken apart or cracked, a clamp can be fastened about the fishplate to hold this and the rails together. Moreover, the clamps themselves are subject to the same stress forces. Replacement of defective and worn rail is costly as this has to be carried out when no trains are using the track.

Additionally, it is important to be able to determine the stress to which a joint is being subjected. This is likely to become more of an issue in the future as the use of the railways expands and trains using a particular stretch of rail become more frequent, faster and also heavier. Also a change over time of readings taken can indicate wear and tear, or even wilful damage to the track or clamp. Means are therefore utilised to determine where problems are likely to occur and so prevent them happening.

Measuring devices are therefore often employed to measure the forces and rail movement experienced by the rail joint. Such forces are dependent on the rail temperature, the speed of a train, the train's mass and also the location of the track. In addition, the stress on a rail section on a curve of the track will differ considerably to that for a section on straight track. Ideally, the device measures the forces in a non-invasive fashion so that taking of the measurements does not itself cause weakening.

Preferably, any measuring device is able to operate without the constant requirement for supervision by an operator and also to transmit measurements to a remote data collector for analysis, thus obviating the need for regular retrieval of information from the device. In addition, the device needs to be able to operate in the open, and so needs to be resistant to weathering.

It is an object of the present invention to provide a clamp which addresses the above problems. It is a further object of the invention to provide a damp which facilitates and improves the measurement of the forces and conditions experienced by a railway rail and/or joint between rails.

SUMMARY OF THE INVENTION

According to the invention there is provided a clamp, the clamp comprising two clamp elements securable together in clamping arrangement about a railway rail;

a first of said two clamp elements having a clamp head to engage a fish plate or a web-side of a railway rail;

a damp foot to engage the underside of a railway rail;

a second of said two clamp elements having a clamp head to engage the opposite fish plate or web-side of a railway rail and a damp foot to engage the underside of the clamp foot of the first clamp element;

a connector to secure the first and second clamp elements together and the clamp to a railway rail.

In this arrangement the forces within the clamp element arising from its being secured in position are more efficiently distributed, increasing the clamp force applied, reducing wear and tear and enabling more accurate measurements to be made by a sensor.

The first clamp element preferably has a clamp arm, the clamp arm and clamp foot co-operating to form a recess to engage about the foot of a rail.

Optionally the second clamp element has a damp arm the damp arm and clamp foot co-operating to form a clamp recess defined by the damp arm at the upper surface of the second damp foot to engage about the foot of a railway rail.

s Preferably each clamp head is rounded to avoid damage to a fish plate or a web-side of a railway rail.

Optionally, each damp foot defines an internal channel, the channels co-operating to form a continuous channel to house the connector, which is preferably a bolt.

Optionally, the surface between the clamp head and the clamp arm is concave to minimise contact between the clamp arm and the rail.

Preferably at least one of the clamp elements includes sensor retaining means to retain a sensor and to allow measurements of the rail to be made.

The sensor retaining means is optionally a recess bore, enabling a sensor to be housed therein.

BRIEF DESCRIPTION OF THE DRAWINGS

The invention is now described with respect to the accompanying drawings which show by way of example only, one embodiment of a clamp. In the drawings.

DETAILED DESCRIPTION OF THE INVENTION

The present invention provides a damp to secure two rails together, such that stresses on the rails themselves are minimised. Moreover the design of the clamp is such that component parts are themselves subjected to less damaging internal forces, with the result that the damp is stronger and needs to be replaced less often. Additionally as less damage is done to the damp, the clamp can normally be reused multiple times.

Additionally a rail clamp in accordance with this present invention can also include a housing for a sensor, the housing being designed to hold the sensor in firm operable attachment to a railway rail in order to monitor such parameters as the force within the rail, rail end movement and the temperature in the clamp both when the rail is not being used and also when a train passes over the rail. The housing holds the sensor firmly and enables the sensor to measure forces generated within the rail without the housing itself affecting the magnitude and the direction of the force induced and so giving a false reading. The sensor is particularly contemplated for use with the housing measuring such parameters as the vertical wheel load from a train, the vertical and lateral acceleration from a train, the instantaneous impact experienced at a joint from a train passing over the joint. In addition the joint gap can be determined from the impact force. This enables an operator to know when a joint is becoming potentially unsafe or is unstable.

Using the data, then wear and tear on a particular track can be surmised in the event that given knowledge of the particular train, the readings alter over time. For example, as the metal in the rail becomes fatigued, the reaction of the rail to a given event will become measurably different.

Figure 1:
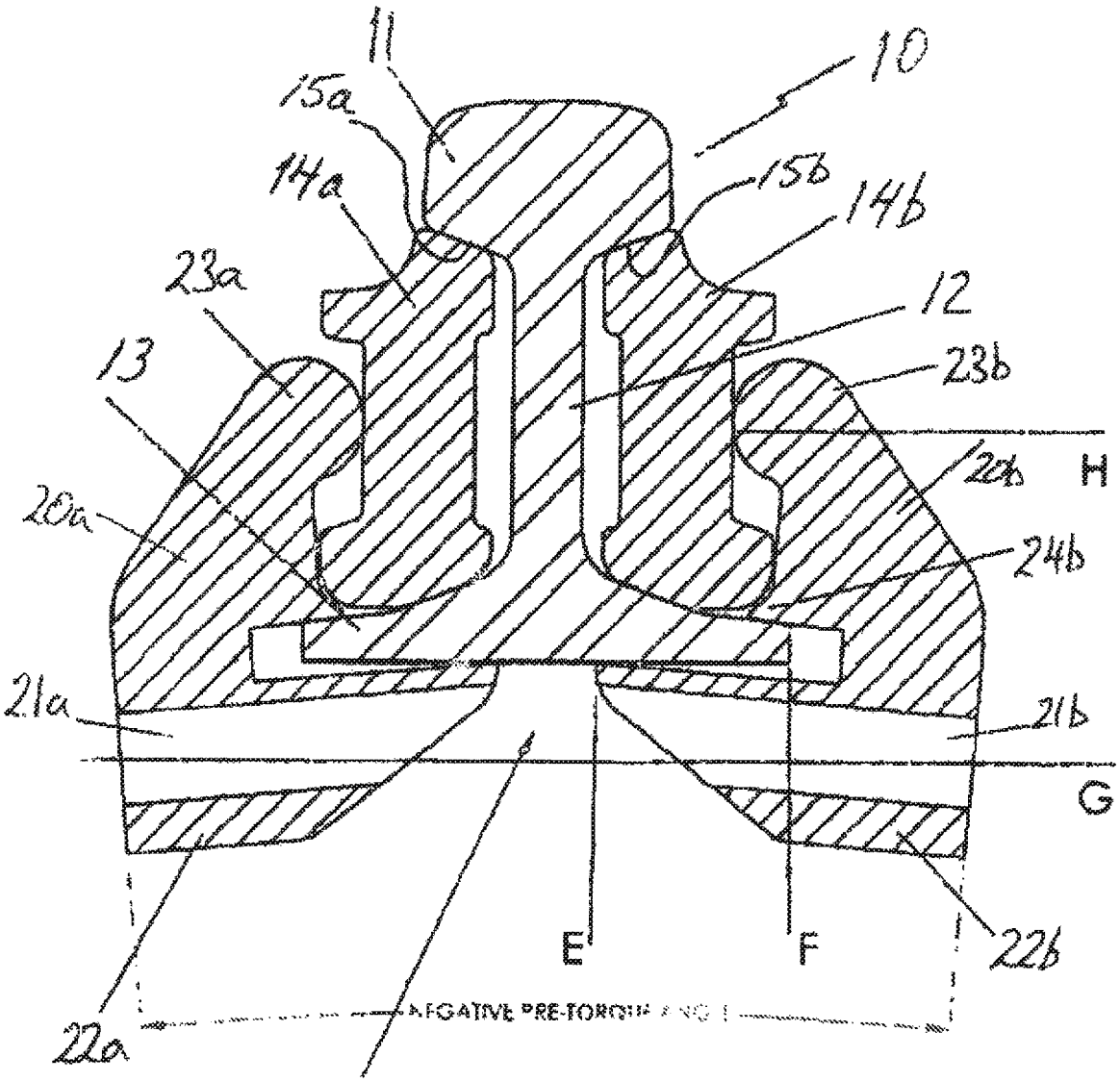
FIG. 1 is a sectional view through a prior art clamp.

Referring now to FIG. 1, this illustrates the general features of a prior art device for clamping rails within a rail joint.

In FIG. 1, a rail is shown in section across its length. The rail 10 is of conventional rail profile having the approximate shape of an I-beam. In general, the rail 10 is formed of a hot-rolled steel, although the invention is suitable for use with rails formed of other materials. The rail 10 shown comprises a head 11 which is profiled to resist wear from the trains and also to provide a smooth ride. Support for the head 11 is provided by a web 12, which is thinner in cross-section than the head 11 to minimise the weight of the rail 10. At the base of the rail 10, the web 12 broadens out to a flat-bottomed foot 13, which can rest directly on sleepers (not shown).

In order to secure adjacent rails together to prevent the rails from separating from one another, adjacent rafts are usually welded together end-to-end or are also secured together using fish plates 14*a*, 14*b*. The fish plates 14*a*, 14*b* are themselves secured together by means of bolts (not shown) which pass through the web 12 of a rail 10. Tightening of the bolts causes the upper and lower tapered surfaces 15*a*, 15*b* to push against the head 11 and foot 13 respectively to wedge the fish plates 14*a*, 14*b* into firm engagement with the conjoined rails.

The prior art rail damp shown, operates in general terms in the same way as the current invention, and is used to describe the operation of such a rail damp.

The rail clamp comprises two clamp elements 20*a*, 20*b* which fit to either side of the rail 10 and are held in close, firm contact with the rail 10.

In order to secure the clamp elements 20*a*, 20*b* together, each clamp element 20*a*, 20*b* has a bore 21*a*, 21*b* through the respective clamp foot 22*a*, 22*b*, which bores 21*a*, 21*b* cooperate to receive a bolt (not shown). As the bolt is tightened it acts to pull the clamp elements 20*a*, 20*b* together and also against the rail/fish plate 10/14*a*, 14*b*.

In more detail, tightening of the bolt exerts a force along the line C in FIG. 1. With respect to the clamp element 20*b* this particular force causes a clamping force between the damp head 23*b* and the fish plate 14*b*. A resulting force along line H, acts between the clamp head 23*b* and fish plate 14*b*. Similar forces act in the opposite direction on clamp element 20*a*. Due to frictional forces between the rail 10 and the clamp elements 20*a*, 20*b* these forces G, H are unequal.

Were a clamp element 20*a*, 20*b* be able to slide over the foot 13 without friction, the forces C and H would be equal. However, friction between the clamp elements 20*a*, 20*b* and the top and bottom surfaces of the foot 13 reduces the magnitude of H significantly. The difference in magnitude between C and H causes a turning force which acts to try and turn the clamp elements 20*a*, 20*b*; for example acting to turn the clamp element 20*b* in a clockwise direction.

The turning force, with reference to the damp element 20*b* causes a reactive force along E and F to be generated which reactive forces act to balance the forces and prevent, incompletely, the clamp element 20*b* from turning. The lines of force E and F are closer together than the lines of force H and G so the forces at E and F are greater than the bolt force applied. Friction between the parts is directly proportional to the force applied, so the friction between the clamp and the rail foot 13 is more significant than the ratio between the bolt force supply and the clamp force will be relatively poor. Additionally, the downward force applied to the edge of the rail foot by the damp arm 24*b* applied to the very edge of the rail foot 13 is high and will induce significant stress within the rail itself.

Additionally, as can be seen from FIG. 1, the rotation of the damp elements 20*a*, 20*b* is sufficient to cause misalignment of the bores 21*a*, 21*b*. This can cause the bolt securing the clamp elements 20*a*, 20*b* to weaken and bend.

Figure 2:
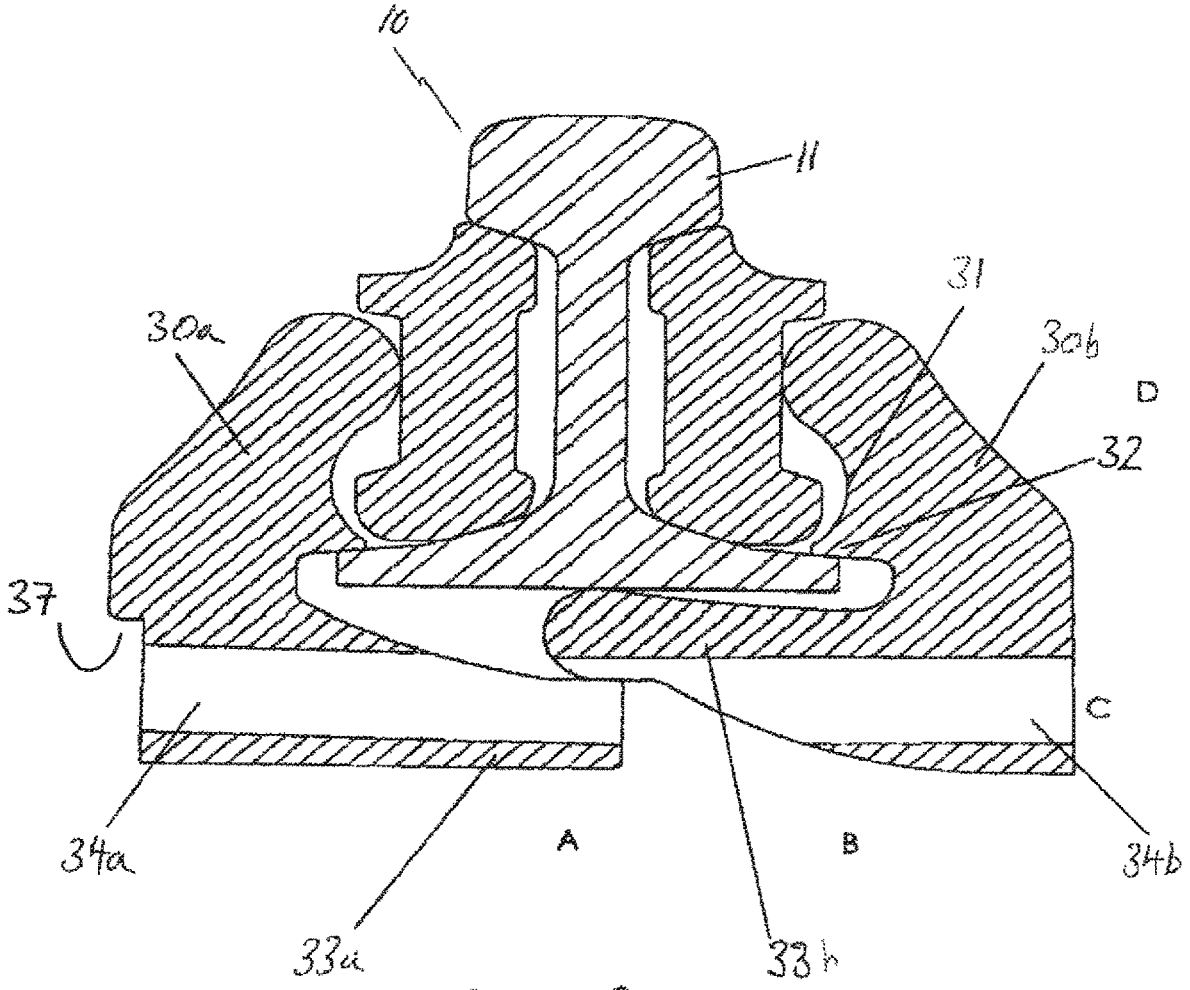
FIG. 2 is a sectional view through an embodiment of the current invention.

The current invention as exemplified by the embodiment shown in FIG. 2, addresses the above problems in the manner described below.

Firstly, the contact between the clamp heads (36*a*, 36*b*) of the clamp elements 30*a*, 30*b* and the fish plate 14*a*, 14*b* is reduced by means of a hollowing out of the neck 31 of the clamp elements and the shortening of the arm 32. The lessening of contact between the arm 32 and the foot 13 also serves to minimise frictional forces between the sensor housing and the rail 10.

Additionally, the clamp foot 33*b* of the clamp element 30*b* extends further across the width of the rail 10 and contacts the rail 10 approximately centrally. This brings the contact point of the clamp element 30*b* and the rail 10 onto the axis line of the web 12.

Figure 3:
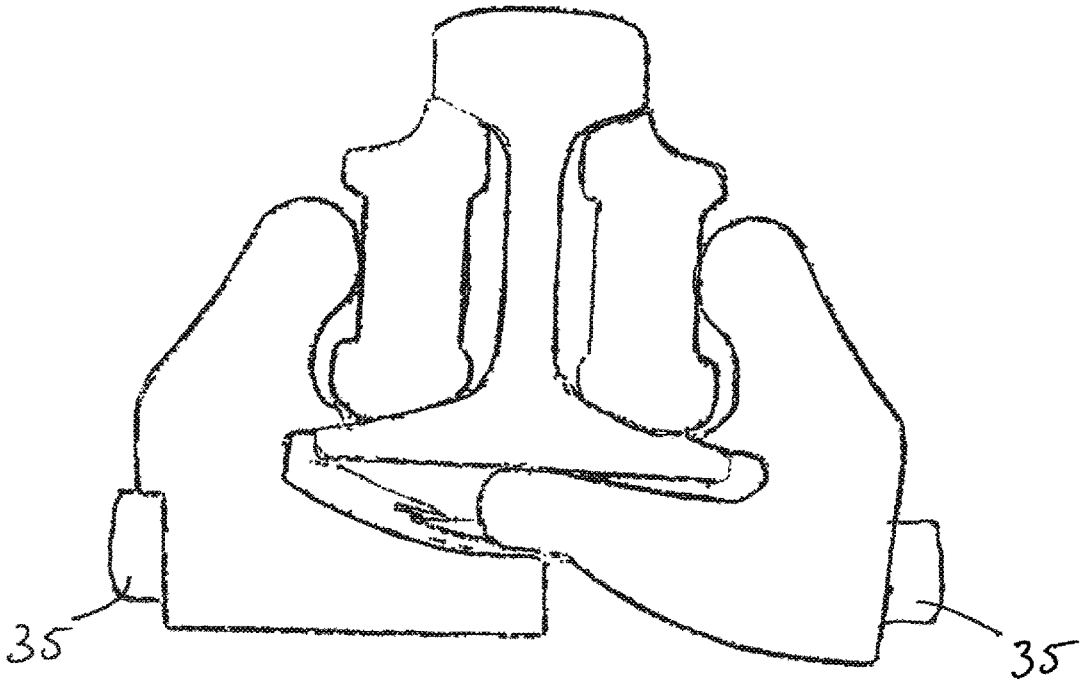
FIG. 3 is a perspective view showing a sectioned joint in accordance with the first embodiment.

The clamp foot 33*a* of the clamp element 30*a* is similarly extended and so profiled that the upper surface of the damp foot 33*a* extends across sufficiently to engage the lower surface of the clamp foot 30*b*. This manner of engagement forces the bores 34*a*, 34*b* to be in alignment. Moreover, as the bolt 35 (see FIG. 3) is tightened, the force acts along the common axis of the bores 34*a*, 34*b*. It has been shown in tests that bolts remain straight even at twice the recommended torque. Indeed the tightening action acts to align the bores 34*a*, 34*b* more strongly along this axis and hence the clamp elements 30*a*, 30*b* are aligned.

In addition, although tightening of the bolt 35 still causes a turning force to arise, a reduced frictional force between the damp elements and the rail 10 and fish plate 14*a*, 14*b* mean that the force is reduced compared to that in the prior art. The reduction is enhanced by the increased lateral separation, compared with prior art housings between the contact points between the clamp elements and the rail foot 13. The stress on the rail foot 13 from the damp elements is therefore reduced. Moreover, the force from the clamp elements 30*a*, 30*b* on the rail 10 is along line A, through the centre of the web 12, which is through the strongest part of the rail 10.

Figure 5A:
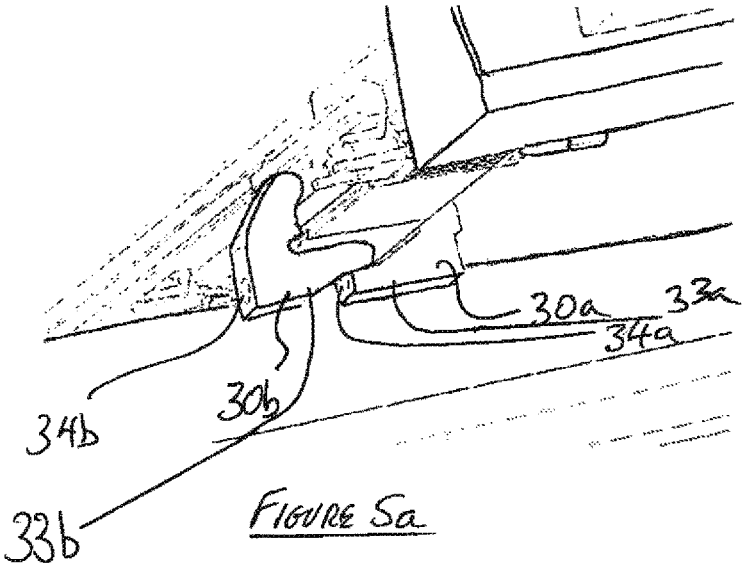
FIGS. 5*a*-5*c* show attachment of a clamp to a rail.
Figure 5B:
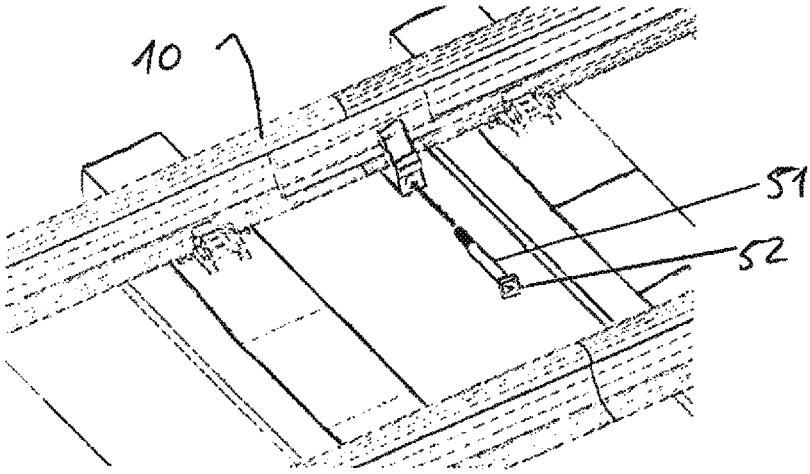
Figure 5C:
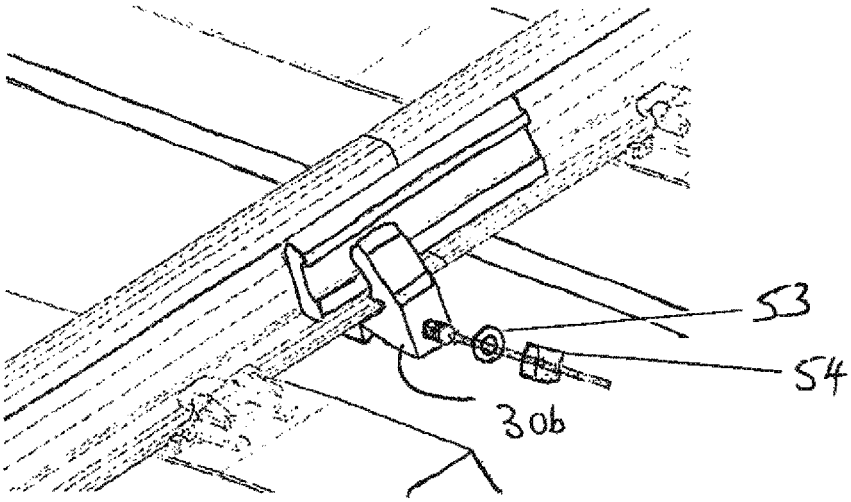
Figure 6:
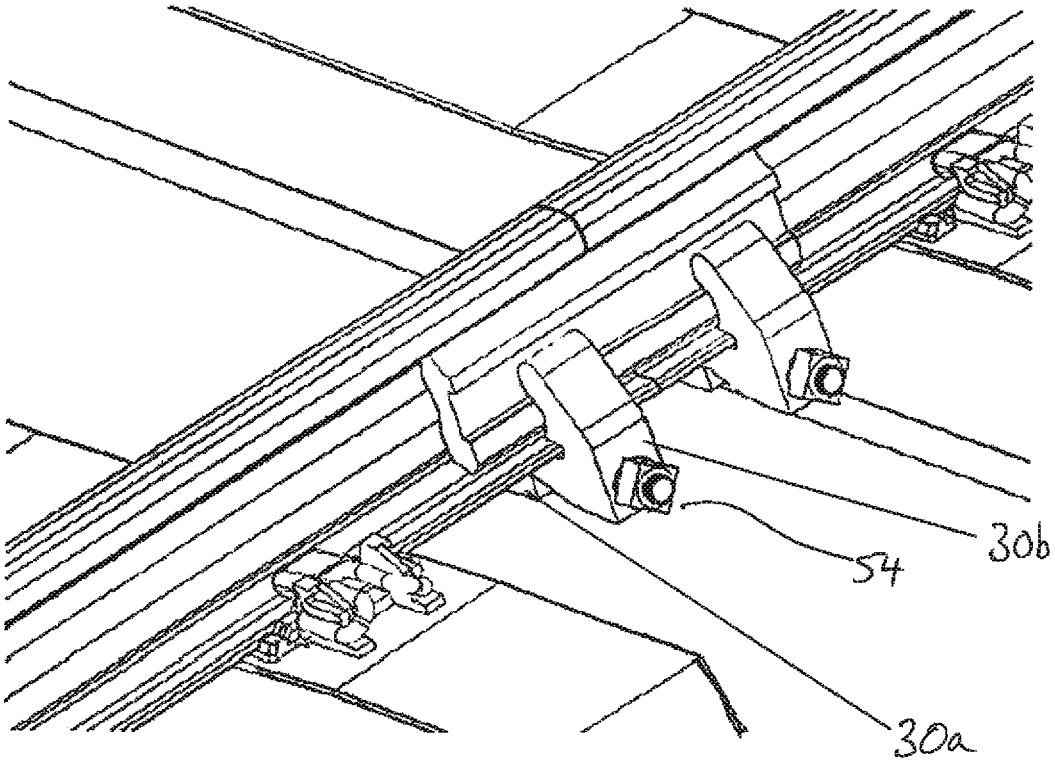
FIG. 6 is a perspective view of a clamp in position.

A method by which clamp elements can be secured to a rail is shown in FIGS. 5*a*-5*c*. Initially clamp elements 30*a*, 30*b* are positioned either side of a rail 10 such that the bores 34*a*, 34*b* are aligned and that the damp feet 33*a*, 33*b* are correctly positioned. A bolt 51 is pushed through the bores 34*a*, 34*b* until the bolt head 52 is located beneath the shoulder 37 on the clamp element 30*a*. A washer 53 and nut 54 are then threadably attached to the protruding end of the bolt 51 and tightened, taking care not to cross-thread. The procedure is then repeated with a second pair of damp elements to produce the arrangement shown in FIG. 6.

The reduction and realignment of the forces means that where the clamp according to the current invention is, in addition to its strengthening function, also used to gather information on the forces and conditions to which the rail joint is subjected, any sensor is more stably housed and so produces better readings. These sensor readings can more accurately reflect those arising from outside forces.

Any forces on the rail 10 therefore are well communicated to the rail clamp and transmitted to a sensor (not shown) held in the housing. The readings taken by the sensor therefore can be used to calculate the forces and conditions experienced by the rail when in use. Further, the impact and effect of a particular rolling stock can be determined and adjustments made if necessary. Moreover, if the readings are seen to be changing over time for the same usage profile, then this will provide an indication that remedial work may be required. Such preventative diagnostics are an obvious advantage in allowing the remedial work to be carried out before catastrophic failure of the rail occurs.

Figure 4:
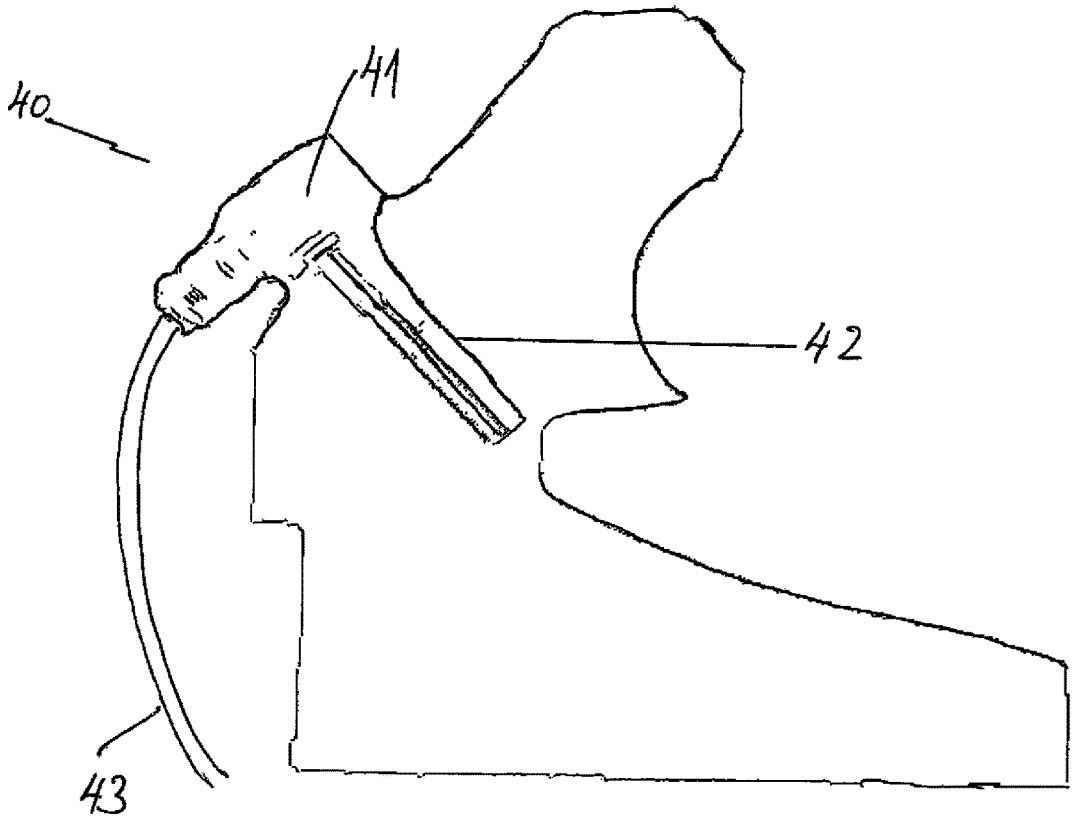
FIG. 4 shows a sensor in position within a clamp element.

Turning now to FIG. 4, the positioning of a typical sensor 40 within the clamp element 30*a* is illustrated. The sensor 40 has sensor head 41, from which extends a probe 42. A lead 43 connects the sensor 40 with a data collector and/or power source. The probe 42 is at an angle of 45 degrees to the vertical axis which enables stress forces in both the horizontal and vertical planes to be detected. In addition, the probe 42 can also be equipped with a temperature sensor, usually capable of measuring temperature to plus or minus 1 degree.

Additionally, the probe 42 can also measure vibration as well as acceleration both horizontally and vertically to plus or minus 70 g.

The sensor can have an integrated battery, which is rated to enable 25 million samples to be taken or to operate for around a year before requiring replacement or recharging. Samples, for a single channel sensor are taken at a rate of around 100 samples per second. A sensor is operable within a temperature range of around −40° C. to 85° C. To minimise disturbance to the forces on the clamp, the sensor is of dimensions 7×4×2.5 cm and has a mass of 110 g.

The information generated can be sent wirelessly to a data logger, for example powered by a 12 volt DC supply at 1 watt. The transmission of the information has a number of benefits. Firstly, costs to an operator are considerably reduced. Where no remote data sensing is used an engineer will have to make regular, often daily, checks on a clamp and rail joint. This is a time consuming act, particularly where a section of rail is in an area not easily accessible by road. Additionally, thefts of clamps are increasingly common and only come to light when the checks are carried out. A continual monitoring of the clamp will therefore lead to a much more rapid realisation of criminal activity than is heretofore possible.

Figure 7:
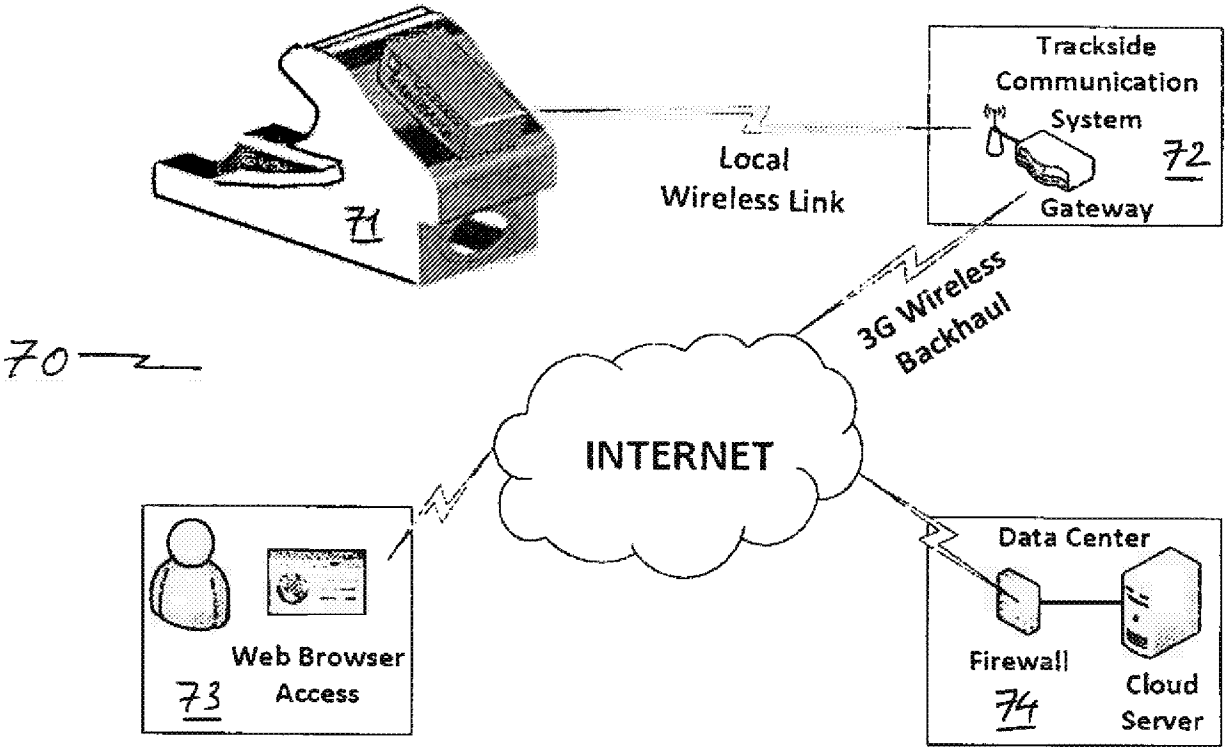
FIG. 7 illustrates a data transmission methodology.

A methodology for the data transmission between sites is illustrated in FIG. 7. At 70 is illustrated a data logger 71, attachable to a damp element, for example as illustrated in FIG. 2. Said data logger 71 can be removably attachable to the damp element by a magnetic fitment or, alternatively, permanently attached by an adhesive such as an epoxy resin. The data logger 71 can be connected to a gateway trackside communication system 72, which acts to boost a signal transmitting data, via an internet link either to a web browser access point 73 or a data centre 74. The access point 73 and data centre 74 can be housed within a central processing coupler to centrally compile data from data loggers over a wide area of a rail network. The data can be linked together to provide reports on a particular section of a rail network to enable decisions to be made on maintenance work.

The sensor itself can be powered by a 5 volt supply at 4-20 and, as exemplified, 5 milliamps. Such power can be generated, if required, by a battery or an array of solar panels located close to the sensor housing.

It will be appreciated that the invention is not limited to specific details described herein, which are given by way of example only, and that various modifications and alterations are possible within the scope of the invention.

The invention claimed is:

1. A clamp comprising two clamp elements securable together in clamping arrangement about a railway rail;

a first of said two clamp elements having a clamp head to engage a fish plate or a web-side of a railway rail;

a clamp foot to engage the underside of a railway rail;

a second of said two clamp elements having a clamp head to engage the opposite fish plate or web-side of a railway rail and a clamp foot to engage the underside of the clamp foot of the first clamp element;

the clamp elements being connectable by means of a connector to secure the first and second clamp elements together and the clamp to a railway rail.

2. A clamp according to claim 1, wherein the first clamp element has a clamp arm, the clamp arm and clamp foot co-operating to form a recess to engage about the foot of a rail.

3. A clamp according to claim 1, wherein the second clamp element has a clamp arm, the clamp arm and clamp foot co-operating to form a clamp recess defined by the clamp arm at the upper surface of the second clamp foot to engage about the foot of a railway rail.

4. A clamp according to claim 1, wherein each clamp head is rounded to avoid damage to a fish plate or a web-side of a railway rail.

5. A clamp according to claim 1, wherein each clamp foot defines an internal channel, the channels co-operating to form a continuous channel to house the connector.

6. A clamp according to claim 5, wherein each connector is a bolt.

7. A clamp according to claim 1, wherein the surface between the clamp head and the clamp arm is concave to minimise contact between the clamp arm and the rail.

8. A clamp according to claim 1, including a sensor retaining means.

9. A clamp according to claim 8, wherein the sensor retaining means is a recess bore.

* * * * *